US006488102B2

(12) United States Patent
Lindsay

(10) Patent No.: US 6,488,102 B2
(45) Date of Patent: Dec. 3, 2002

(54) HAND-HELD PNEUMATIC IMPACT POWER TOOL

(76) Inventor: Steven James Lindsay, 3714 W. Cedar Hills Dr., Kearney, NE (US) 68845

( * ) Notice: Subject to any disclaimer, the term of this patent is extended or adjusted under 35 U.S.C. 154(b) by 63 days.

(21) Appl. No.: 09/754,889

(22) Filed: Jan. 5, 2001

(65) Prior Publication Data

US 2002/0088626 A1 Jul. 11, 2002

(51) Int. Cl.[7] ..... B25D 9/14
(52) U.S. Cl. ..... 173/115; 173/128; 173/207
(58) Field of Search ..... 173/115, 128, 173/206, 207, 14, 15, 16, 17

(56) References Cited

U.S. PATENT DOCUMENTS

| | | | | |
|---|---|---|---|---|
| 1,691,372 A | * | 11/1928 | Bayles | 173/16 |
| 3,393,755 A | | 7/1968 | Glaser et al. | |
| 4,030,556 A | | 6/1977 | Phillips | |
| 4,416,338 A | * | 11/1983 | Nelson et al. | 173/134 |
| 4,502,824 A | * | 3/1985 | Dohse et al. | 409/234 |
| 4,694,912 A | | 9/1987 | Glaser | |
| 5,203,417 A | | 4/1993 | Glaser | |
| 5,419,403 A | * | 5/1995 | Klemm | 173/115 |
| 5,449,044 A | | 9/1995 | Phillips | |
| 5,515,930 A | | 5/1996 | Glaser | |
| 5,803,183 A | | 9/1998 | Phillips | |
| 5,930,899 A | * | 8/1999 | Hartman et al. | 30/168 |
| 6,021,574 A | | 2/2000 | Murray | |
| 6,085,850 A | | 7/2000 | Phillips | |
| 6,095,256 A | | 8/2000 | Lindsay | |

OTHER PUBLICATIONS

Rio Grande Tools & Equipment 1996 Catalog, Hand Engraving section of catalog, pp. 91 through 95.
Rio Grande Tools & Equipment 2001 Catalog, Hand Engraving section of catalog, pp. 258 through 265.

* cited by examiner

*Primary Examiner*—Stephen F. Gerrity
*Assistant Examiner*—Brian Nash

(57) ABSTRACT

A hand-held pneumatic impact tool for use in fine hand working operations includes a mechanism for adjusting impacting characteristics of the device that is conveniently located and adjusted by the user. The mechanism includes an annular band protruding around the outside diameter of the body of the impact tool that may be turned for adjusting an annular ring in the bore of the tool and thus altering the distance required for the piston to reach impact collision with the anvil. The impact tool also includes a handle containing a receiving-recess and a handle-attachment unit to permit manual removal and installation of the handle. The handle-attachment unit includes more than one protruding member positioned a distance into the receiving-recess, more than one groove on the outside diameter of body and running a distance and in a direction substantially parallel with the central longitudinal axis of the body and then changes direction and rotates around the central longitudinal axis of the body a distance.

8 Claims, 5 Drawing Sheets

HAND-HELD PNEUMATIC IMPACT POWER TOOL

BACKGROUND OF THE INVENTION—Field of Invention

The present invention relates to impact power tools and, more particularly, to an improved hand-held pneumatic impact power tool for delicate hand engraving and stone setting in the hand engraving and jewelry fields.

BACKGROUND OF THE INVENTION—Description of Prior Art

An impact power tool is known from my earlier U.S. Pat. No. 6,095,256, to Lindsay, which may be used for engraving, carving and delicate stone setting operations. A type of device described in my earlier patent is incorporated herein by reference in order to help with the need for further discussion of the types of devices with which the present invention may be employed.

Although the known impact power tool mentioned above provides improved control of delicate hand-working operations not previously available, it would be desirable to provide a impact power tool with additional features to provide greater ease of use. A known embodiment disclosed in my earlier U.S. Pat. No. 6,095,256, to Lindsay, uses a unique feature to adjust the impacting characteristics of the tool. This feature is very beneficial to users, although to modify this impacting adjustment takes valuable time from the jeweler or engraver, as two setscrews need to be loosened before the user can begin to adjust.

Another embodiment disclosed in U.S. Pat. No. 6,095,256, to Lindsay is the a feature that gives more than one placement (chosen by the user) for tubing attachment to the impact power tool. This tubing placement feature uses small plugs to plug holes that are not in use. These small plugs can be easily lost and it takes time to move the tubing attachment to the desired position.

Another feature that needs improvement is how the handles are held on bodies of power tools such as these. The handles must have an airtight seal and yet they must be easily removed for the jeweler and engraver to facilitate cleaning the bore and piston and/or to change to a different weighted piston.

Further, as is addressed in U.S. Pat. No. 5,203,417, to Glaser a power tool that permits users to easily replace the tip of the tool with an alternate tip without having to tighten and loosen a threaded connection or setscrew can speed the work for jewelers or engravers and presents an advantage. The disadvantage of the system disclosed in U.S. Pat. No. 5,203,417, to Glaser is that users are required to fasten all tool tips into a specially designed tool carrier block that is then placed into a mating recess in the power tool. With this system, the user is still required to use a threaded setscrew to fasten the tip into the tool carrier block taking more time than desired.

OBJECTS AND SUMMARY OF THE INVENTION

In accordance with the present invention, a handheld impact power tool that overcomes the problems discussed above and which provides a convenient and unique mechanism for users to adjust length and speed of stroke quickly. The unique mechanism includes an annular band protruding around the outside diameter of the body of the impact power tool that may be turned for adjusting an annular ring in the bore of the impact power tool and thus altering the porting and the impacting characteristics of the impacting piston.

In accordance with the present invention, a handheld impact power tool that provides a feature for attaching air supply tubing to the power tool that may be moved around freely on the outside body of the power tool. The attachment feature includes an annular band around the outside diameter of the body of the power tool that attaches the air supply tubing. This annular band may be rotated and slid along the axis of the body to a position favored by the user.

Further, in accordance with the present invention, a handheld impact power tool that provides a handle that may be manually pushed on and turned to lock. The feature includes more than one pin fixed into the female receptacle handle. These pins are radial aligned and protruding a short distance into the inside diameter of the female receptacle. Included on the outside diameter of the body of the power tool are slots or grooves that permit the pins and handle to slide on and turn and thus tightening against an O-ring between the handle and body, thus sealing and holding the handle onto the body.

Finally, in accordance with the present invention, a handheld impact power tool that provides a simple and convenient construction method that permits quick interchangeability of tool tips. The method includes an o-ring made of a resilient material located inside of the tool holding recess for a friction fit to tool tips. The method also includes a setscrew that is friction fit so as not to vibrate within its mating threads. The screw is perpendicular to the axis of the tool holding hole and is used to index square shank tool tips that are commonly used in the jewelry and engraving fields. The screw is left slightly loosened from the shanks of the tool tips so that tool tips may be removed and replaced quickly. This setscrew may also be used to tighten a round shank tool tip permitting a secure attachment.

BRIEF DESCRIPTION OF THE DRAWINGS

Embodiments of the present invention are described below with reference to attached drawing figures, wherein.

DETAILED DESCRIPTION OF THE PREFERRED EMBODIMENT

Figure 1:
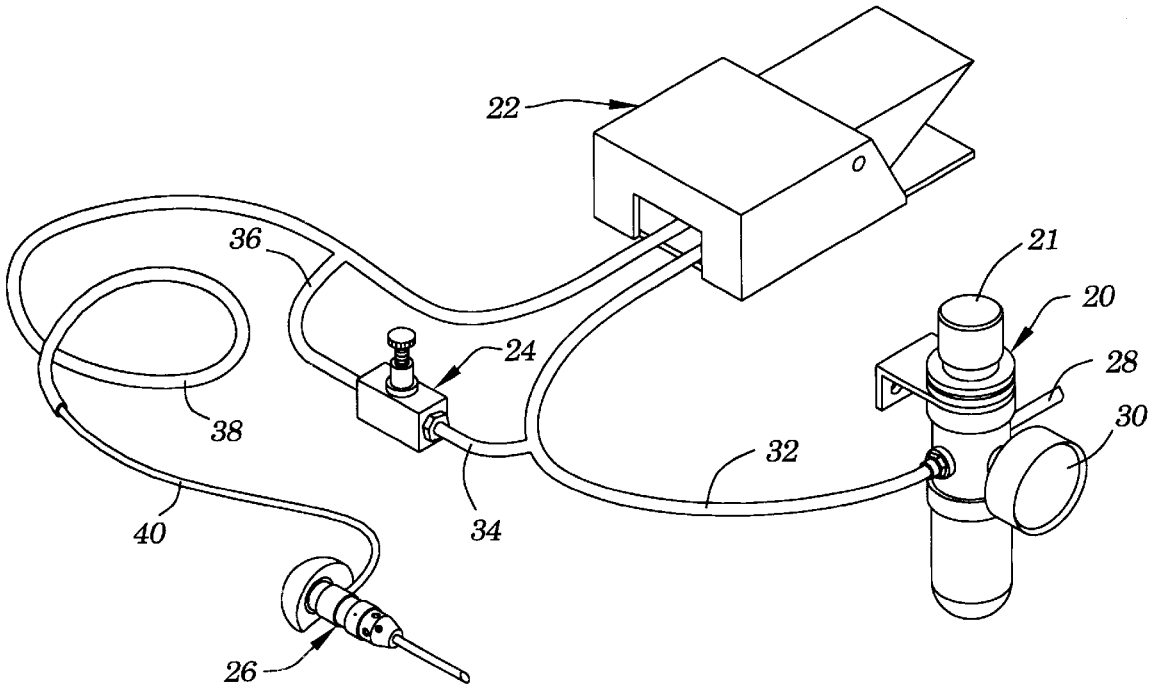
FIG. 1 is a perspective view of a hand-held impact power tool system constructed in accordance with the present invention.

A hand-held pneumatic impact power tool system in accordance with the present invention is illustrated in FIG. 1. The apparatus includes an air supply line 28, a hand operated pressure regulator assembly 20, a foot-operated flow control valve assembly 22, a distribution line 32 extending between the hand operated pressure regulator assembly 20 and the foot-operated flow control valve assembly 22, an impact handpiece 26, a delivery line 38 and reduced diameter delivery line 40 extending between the foot-operated flow control valve assembly and the handpiece, and a hand-operated flow control needle valve 24 spliced between the distribution line 32 and delivery line 38 via lines 34 and 36.

The air supply line 28 connects the pressure regulator assembly 20 to a source of pressurized air, such as a conventional air compressor. The pressure regulator assembly 20 includes an inlet connected to the supply line 28, an outlet connected to the distribution line 32, and a valve for regulating air flow between the inlet and the outlet. In addition, the pressure regulator assembly 20 includes a pressure-sensing element for sensing the pressure of the air distributed from the regulator and for controlling the regulator to limit the pressure of the distributed air. A hand-operated knob 21 is connected to the pressure regulator assembly 20 for adjusting the regulated pressure distributed by the regulator. A gauge 30 is provided on the regulator to monitor the pressure being distributed.

Figure 2:
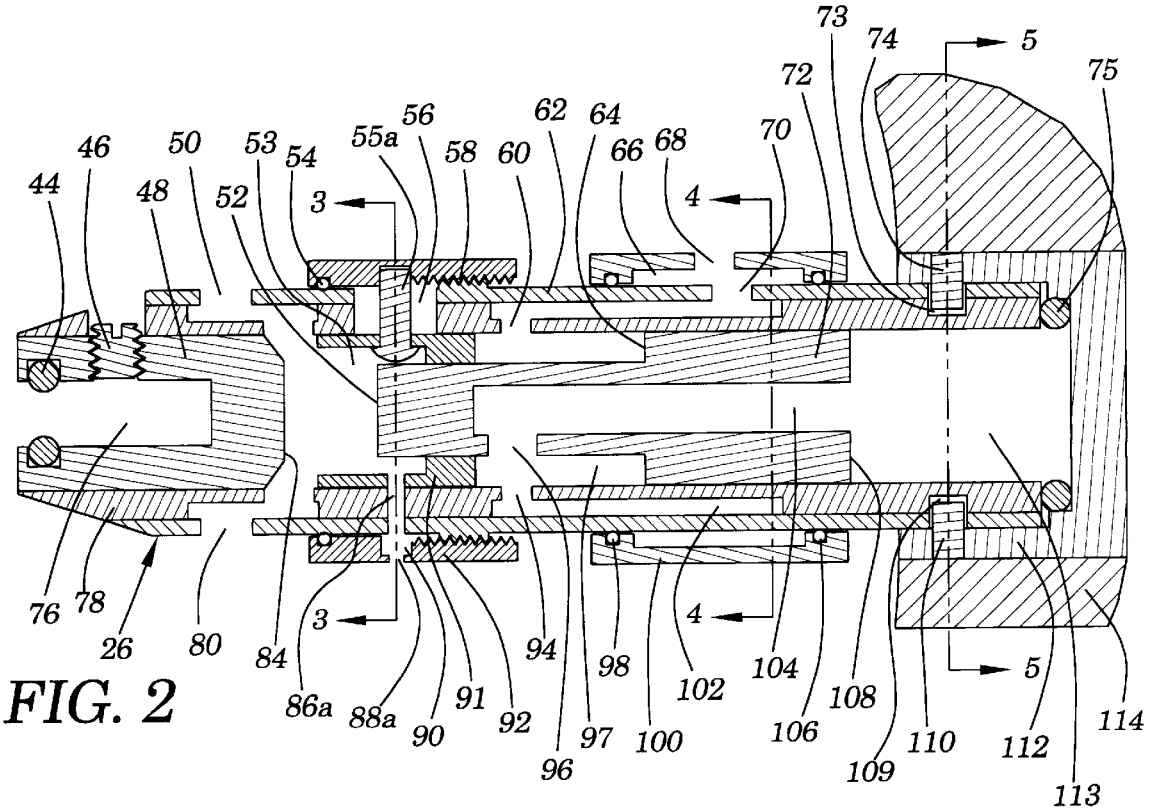
FIG. 2 is a sectional view of a hand-held impact power tool constructed in accordance with the present invention.
Figure 3:
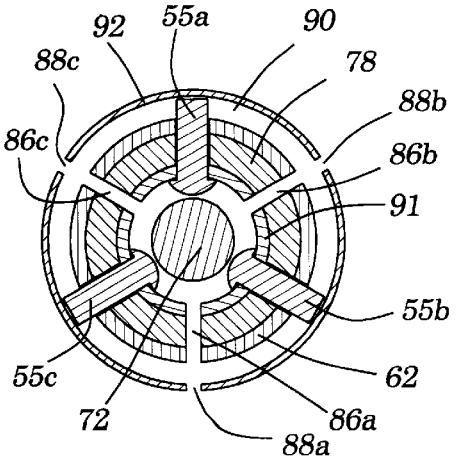
FIG. 3 is a sectional view taken along 3—3 of FIG. 2.
Figure 4:
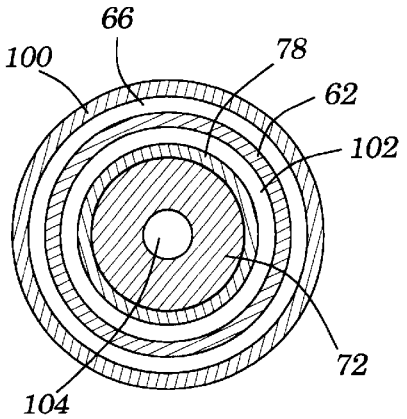
FIG. 4 is a sectional view taken along 4—4 of FIG. 2.

An impact handpiece 26, is illustrated in FIG. 2 in accordance with the present invention and includes a body shell 62 that is fixed over the outside diameter of a body 78 that includes an outside diameter and internal cavity. An anvil 48 is fixed in position within the impact end of the internal cavity of the body 78. An annular ring 91 is contained within the internal cavity of the body 78 that can move axially with a free sliding fit within the internal cavity. The internal cavity also accommodates a two-step piston 72 that can move axially within the internal cavity. An adjustable tubing attachment ring 100 is fit with two o-rings 98 and 106 that give an airtight, yet sliding axially and rotary fit around the body shell 62. The tubing attachment ring 100 is provided with an airline intake port 68. A recess 66 is provided in the inside diameter of the tubing attachment ring 100. A body shell intake port 70 is provided in communication with the recess 66. An air-in recess 102 is provided on the outside diameter of the body 78 that is in communication with bore intake ports 60 and 94. Air-in recess 102 on the body 78 and recess 66 in the adjustable tubing attachment ring 100 may be viewed in the sectional view in FIG. 4. Referring back to FIG. 2, a length of stroke barrel 92 and body shell 62 are provided with mating threads 58 so that the length of stroke barrel 92 may move along its axis as it is manually rotated around the body shell 62. An o-ring 52 is provided between these parts to provide some friction so that the length of stroke barrel 92 will not vibrate or rotate accidentally during impacting usage. Referring to FIG. 2 and FIG. 3., three pins 55*a*, 55*b*, and 55*c* (these could also be screws) have a secure, tight fit in the annular ring 91 and protrudes out from the annular ring into a provided slot 56 for each (only one slot is shown, and that is the slot for pin 55*a*, FIG. 2). The slots are milled through both the body shell 62 and the body 78. These three slots are the width of pins 55*a*, 55*b*, and 55*c* so that they provide a sliding fit to the pins. The length of the pins 55*a*, 55*b*, and 55*c* run in a perpendicular direction to the axis of the body and protrude out of body shell 62. Referring to FIG. 2 and FIG. 3, three small holes 86*a*, 86*b*, and 86*c* are provided in line axially to and across from pins 55*a*, 55*b*, and 55*c*. These three holes along with three more holes 88*a*, 88*b*, and 88*c* in the length of stroke barrel 92 are used for accessing and installing pins 55*a*, 55*b*, and 55*c*. A pin recess groove 90 (FIG. 2 and FIG. 3) is provide in the inside diameter of the length of stroke barrel 92. This groove 90 is the width of pins 55*a*, 55*b*, and 55*c* so it will provide a sliding fit to the pins.

The two-step piston 72 provided in the internal cavity of the body 78 divides the internal cavity into the following three chambers:

- a head chamber 53 defined by the front piston face 52, an end face 84 of the anvil 48, and one side of the annular ring 91. This head chamber constantly communicates with the atmosphere through exhaust ports 50 and 80;
- a central chamber 97 defined by the piston step end face 64, the external diameter of the smaller step of the piston, and one side of the annular ring 91. This central chamber constantly communicates with the compressed air source through intake ports 60 and 94;
- a rear chamber 113 defined by the rear piston face 108 and an end cap 112. Depending on the position of the piston relative to the body, this rear chamber periodically communicates with a compressed air source through passage 104, piston port 96, and intake ports 60 and 94, or with the atmosphere through passage 104, piston port 96, and exhaust ports 50 and 80.

A tool tip recess 76 is provided to hold a tool tip in the anvil 48 and by tightening setscrew 46. Alternately, users may adjust setscrew 46 slightly loose and square shank tool tips that are commonly used in the jewelry and engraving fields my be quickly removed and installed without having to loosen and tighten setscrew 46. When setscrew 46 is used in this manner it functions as an index to prevent square or round shank tool tips with a flat from rotating. An o-ring 44 being formed of a resilient rubber type material is provided in the anvil in a location as depicted in FIG. 2. This o-ring 44 provides a snug friction fit to tool tip shanks. It provides a means to hold the toot tip shanks with enough friction to hold them in recess 76, yet the user can manually remove them easily.

Figure 5:
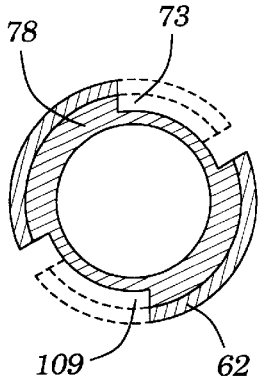
FIG. 5 is a sectional view taken along 5—5 of FIG. 2, but with the handle and end cap removed.

A handle 114 is comfortably shaped to fit into the palm of the hand and to provide bottom clearance as the tool is used over the work. The handle 114 is permanently fixed onto an end cap 112. The end cap 112 attaches over the body shell 62 with an airtight seal. The attachment method includes pins 74 and 110 that are permanently fixed onto and protruding slightly into the inside diameter of the end cap 112. Two slots 73 and 109 are provided on the body shell 62 and also slightly into the outside diameter of body 78. These two slots are the width of pins 74 and 110 providing a sliding fit. These slots run from the handle end of the body shell 62 a distance and then rotate a distance around the diameter. Slots 73 and 109 are illustrated in FIG. 5. Note: handle 114, end cap 112, and pins 110 and 74 have been removed from the illustrated sectional view in FIG. 5. To attach the handle 114 and end cap 112, users line up pins 74 and 110 with slots 73 and 109, the handle is pushed on and turned. End cap 112 is drawn on tightly against o-ring 75 creating an airtight seal.

Operation

Figure 6:
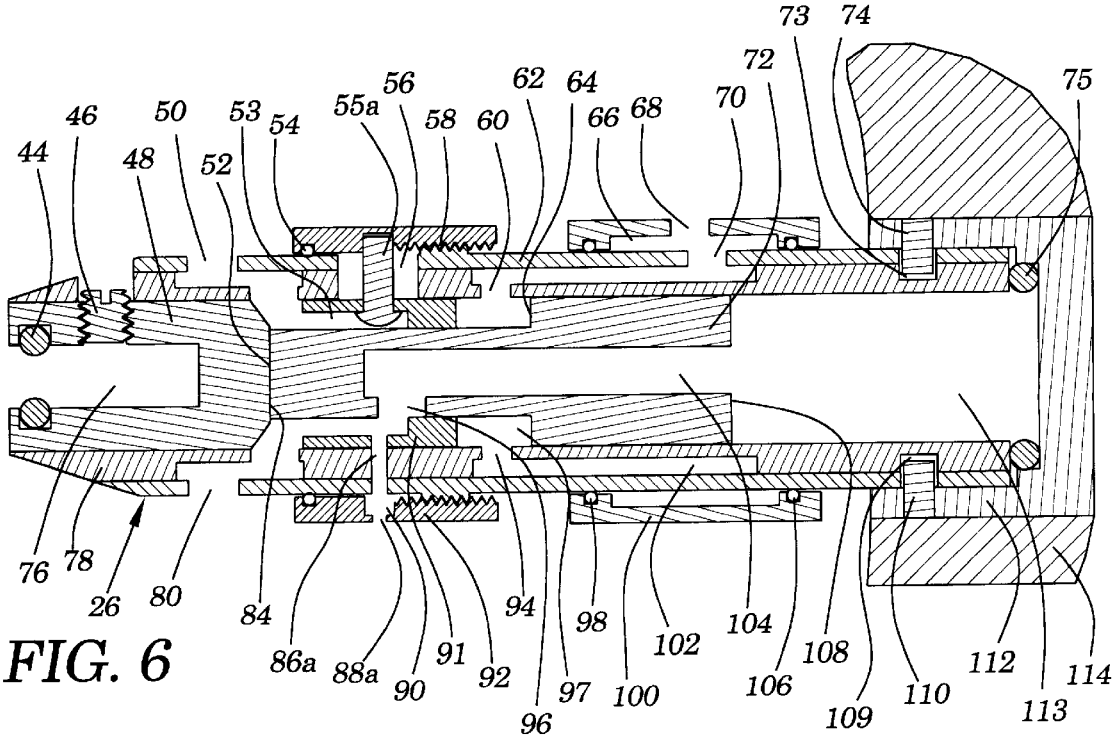
FIG. 6 is the same view as FIG. 2, differing in that the piston is occupying the extreme forward position.

The hand-held pneumatic impact power tool operates as follows. Referring to FIG. 2, when compressed air is introduced to the airline intake port 68 and piston 72 is in a position illustrated in FIG. 2, compressed air will fill the central chamber 97 via bore intake ports 60 and 94 and also the rear chamber 113 via piston port 96 and passage 104. The air pressure in the central chamber will attempt to push the piston further to the rear of the internal cavity by pressing against the piston step end face 64, but the air pressure in the rear chamber 113 will attempt to push the piston in the opposite direction toward the front of the cavity by pressing against the rear piston face 108. Because the surface area of the rear piston face 108 is greater than the surface area of piston step end face 64, the piston will shift toward the front of the cavity until the front piston face 52 collides with end face 84 of the anvil 48, thus delivering an impact. While the piston was traveling toward the end face 84 of the anvil 48, piston port 96 for a short time was aligned with annular ring 91 and the compressed air from the central chamber was then shut off to piston port 96 and thus to the rear chamber 113. With continuing movement of the piston toward the end face 84 of the anvil 48, piston port 96 became in communication with head chamber 53 permitting the air pressure that was built up in the rear chamber 113 to be released into the atmosphere through passage 104 in the piston, to the head chamber 53, and finally out exhaust ports 50 and 80. With the piston in this front most position now illustrated in FIG. 6 and the air pressure released out of the rear chamber 113, the air pressure in the central chamber 97 pressing against the piston step end face 64 and together with an impacting recoil will shift the piston back to the rearward position illustrated in FIG. 2. With the piston in this rearward position, piston port 96 is now back in communication with central chamber 68 and air pressure from bore intake ports 60 and 94. The air pressure will again build in rear chamber 113 through passage 104 and the process is repeated, thus oscillating the piston.

Figure 7:
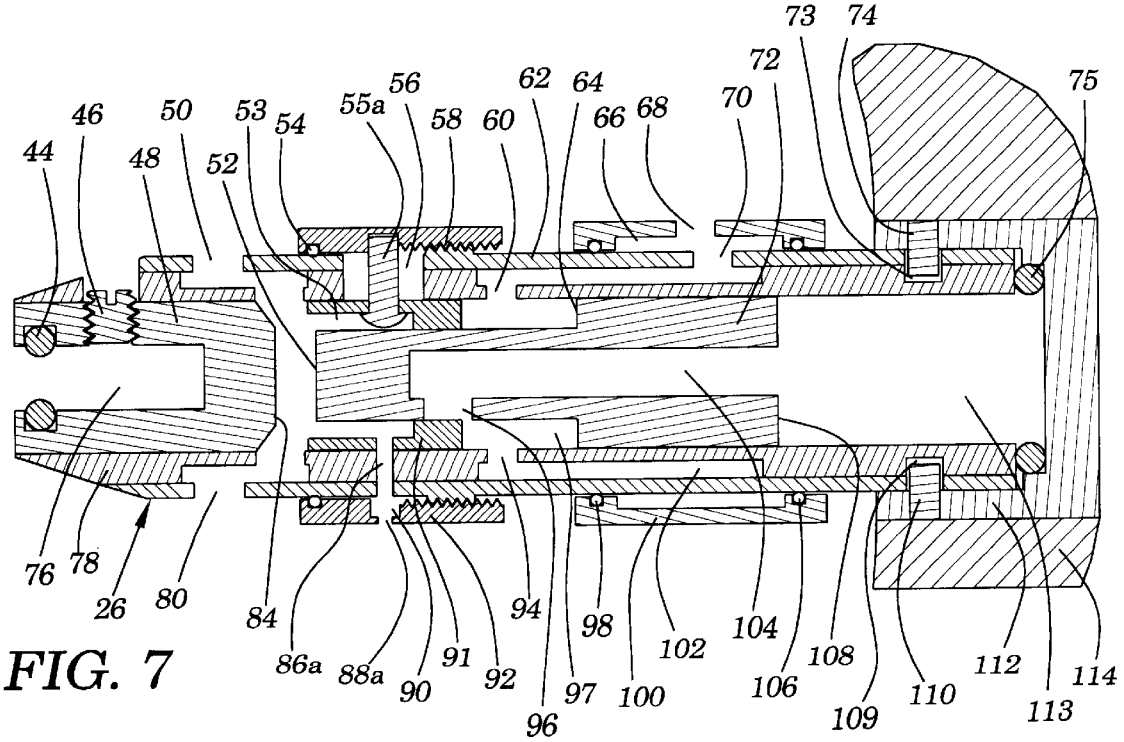
FIG. 7 is the same view as FIG. 2, differing in that the piston is occupying a slight rearward position.
Figure 8:
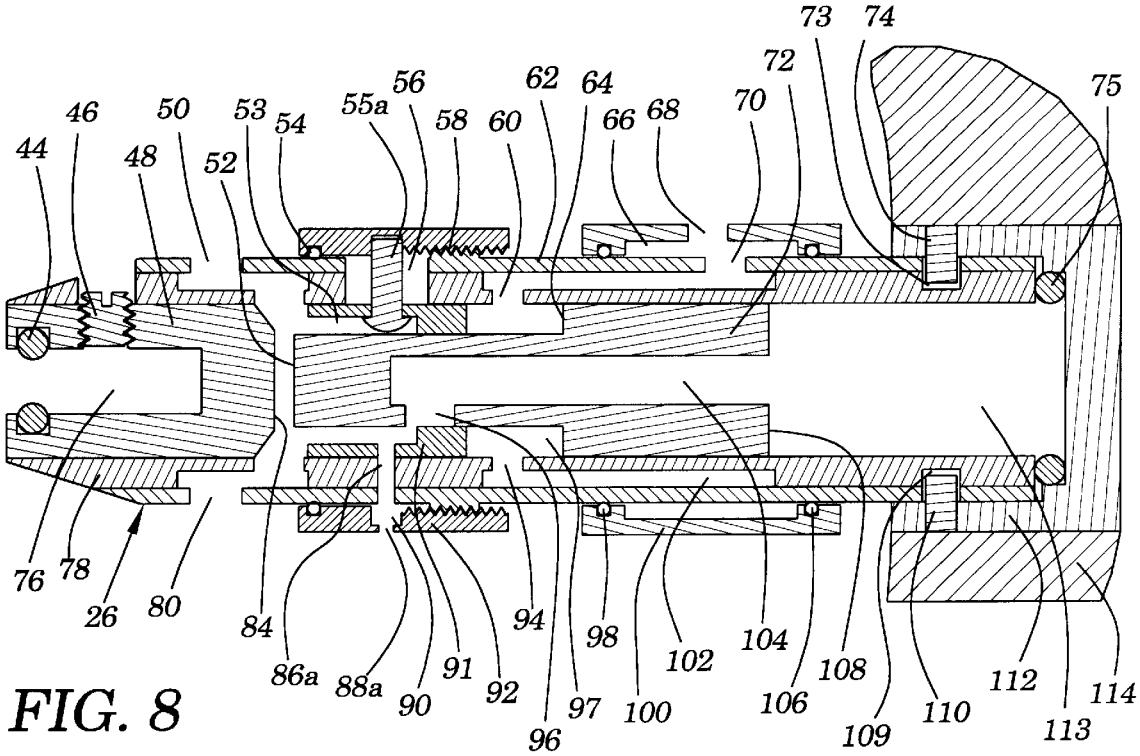
FIG. 8 is the same view as FIG. 2, differing in that the piston is occupying a slight forward position.

Illustrations FIG. 7 and FIG. 8 depict the idling ready-state of the impact handpiece. This idling state is similar to what is described above except the piston oscillates with a very short movement stroke and without the front piston face 52 colliding or impacting with the end face 84 of the anvil 48. This idling state can be achieved with very short movement strokes because piston port 96 is the same width as the annular ring 91. With this configuration the piston port 96 can move a very short distance to either side from alignment with the annular ring 91 for receiving and exhausting sufficient air pressure to oscillate the piston. The air pressure and airflow required for this idling oscillation are very low. FIG. 8 depicts the idling state with the piston shifted to the front position and the piston port 96 in communication with head chamber 53. FIG. 7 illustrates the idling state with the piston shifted to the rear position and piston port 96 in communication with central chamber 97.

Referring to FIG. 1, the hand operated pressure regulator assembly 20, the foot-operated flow control valve assembly 22, and the hand operated flow control needle valve 24 operate together supplying the needed airflow to the handpiece as follows. With an air compressor or the like supplying air pressure through the supply line 28, the hand-operated pressure regulator 20 is adjusted to the desired pressure by turning knob 21 and viewing pressure gauge 30. The hand-operated flow control needle valve 24 is adjusted to permit a fine flow of air between the distribution line 32 and delivery line 38 and the reduced diameter delivery line 40 and finally to the handpiece 26. This will permit the piston to begin oscillating in an idling state within the handpiece. The hand-operated flow control needle valve 24 is adjusted so that the idling is faint with slight piston oscillation. The idling impact handpiece is now ready for impact operation. The user places the idling impact tool's graver or tool tip onto the work and slowly depresses the foot pedal of the foot-operated flow control valve assembly 22. The piston in the handpiece will begin delivering light impacts. As the user continues to depress the foot pedal, thus increasing air pressure to the handpiece, the piston will deliver harder and harder impacts. When the user has finished an engraving or stone setting operation he or she lets up on the foot pedal and the impact tool will return to the idling oscillation ready-state.

Figure 9:
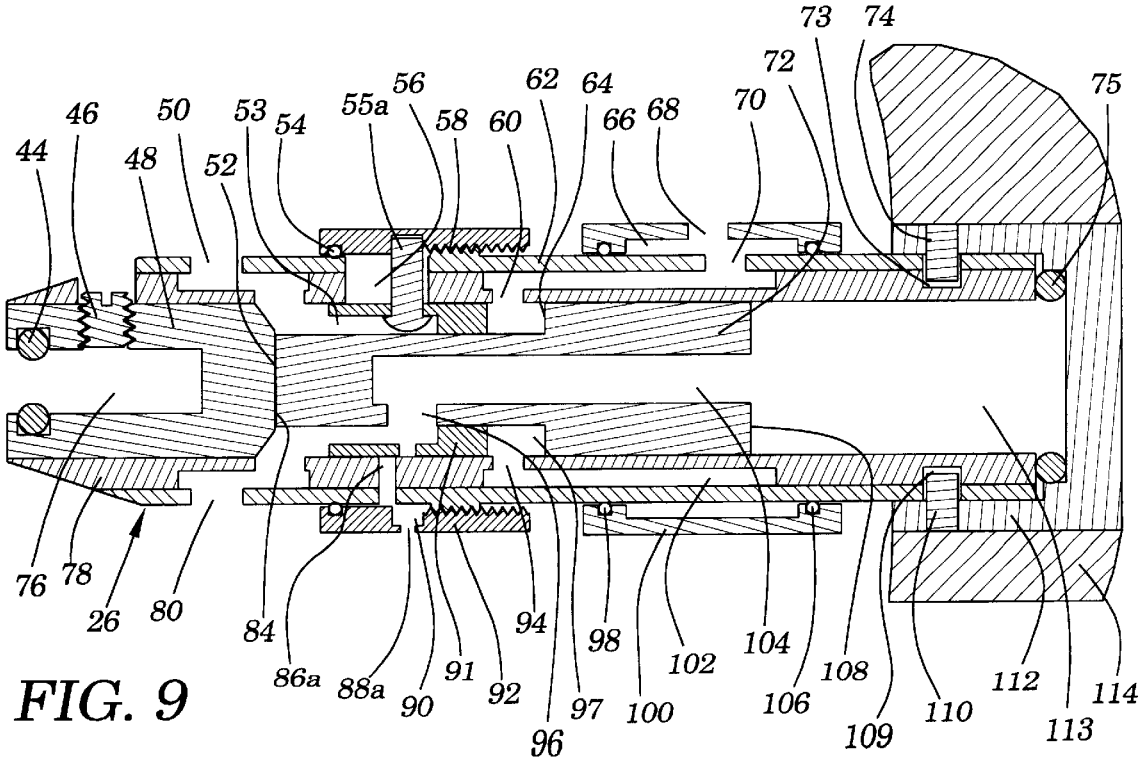
FIG. 9 is the same view as FIG. 2, differing in that the length of stroke annular barrel is adjusted to the longest stroke and the piston is occupying the extreme forward position.
Figure 10:
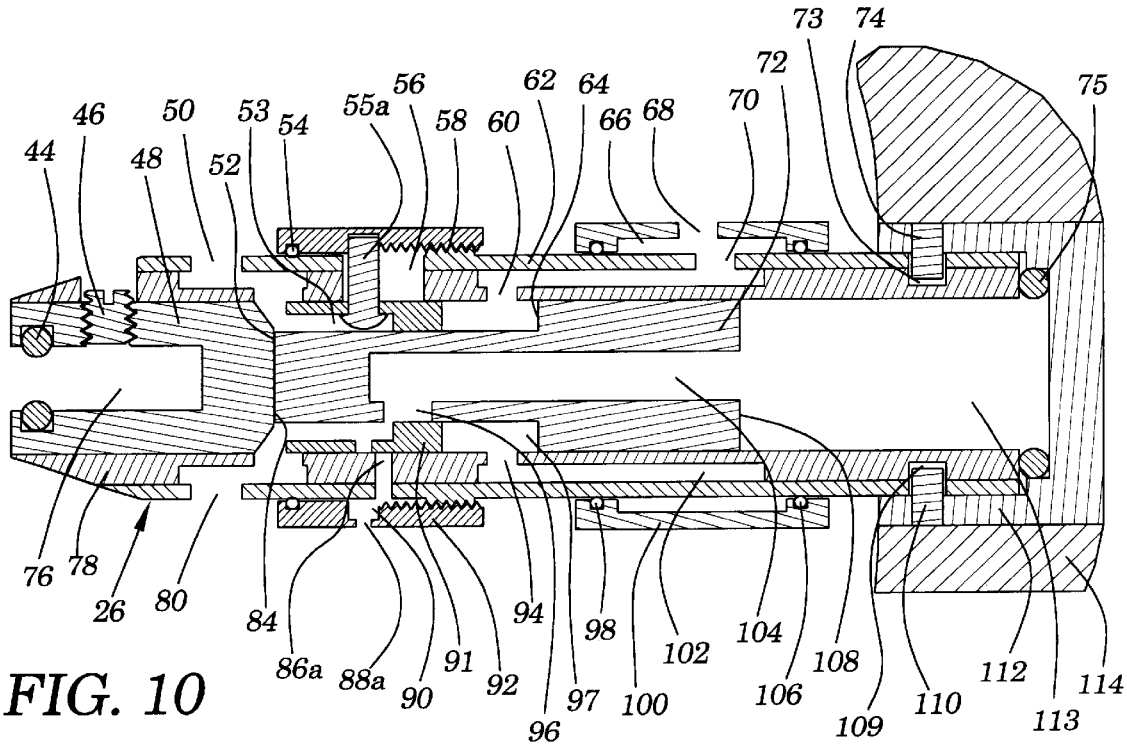
FIG. 10 is the same view as FIG. 2, differing in that the length of stroke annular barrel is adjusted to the shortest stroke and the piston is occupying the extreme forward position.

Illustrations FIG. 9 and FIG. 10 depict how the impacting characteristics of the handpiece can be altered by the jeweler or engraver by adjusting the length of stroke barrel 92. In FIG. 9 the length of stroke barrel 92 has been turned on threads 58 moving the barrel toward the handle 114 end of the handpiece. Referring to FIG. 3, because pins 55*a*, 55*b*, and 55*c*, are securely attached to annular ring 91 and because these pins are protruding into pin recess groove 90 in the length of stroke barrel 92, the annular ring will therefore move longitudinally within the internal cavity of body 78 together with the length of stroke barrel 92. Referring to FIG. 9, by adjusting the annular ring 91 along its axis within the handpiece by this mechanism it is possible to adjust the speed of the piston impacts and the length of strokes, which will affect the impact power range of the handpiece without air flow or pressure to do so. The location of annular ring 91 within the bore determines the central location where piston 72 oscillates. When piston port 97 is either side of alignment with annular ring 91 piston 72 will begin to receive energy to shift directions from the direction it is traveling during the oscillation cycle even though piston 72 will continue to travel in its original direction for a time through inertia. Depending on the air pressure delivered to the tool through the foot-operated flow control valve assembly, the travel distance of the piston (equal on either side of annular ring 92) will be determined. By placing an obstacle (anvil 48) a distance away and within reach of the oscillating piston (determined by the air pressure delivered to the handpiece) the travel distance of the piston on one side of annular ring is interrupted with an early termination of continued movement providing an impact collision between the piston and anvil. Adjusting length of stroke barrel 92, and thus annular ring 91 rearward (towards handle 114) the central location of the oscillating piston is moved further away from anvil 48. In this position the piston will require more air pressure delivered by the person operating the foot-operated flow control valve in order for the piston to gain enough inertia to begin to reach and collide into end face 84 of the anvil 48. After impact the piston will rebound or bounce to some degree from the collision. This bounce energy together with the return stroke pneumatic energy helps in the return stroke. Referring to FIG. 10, when length of stroke barrel 92 is adjusted in the opposite direction than just described so that annular ring 91 is moved forward (away from handle 114) and having piston 72 in its front most position (i.e. making an impact) the air pressure and flow delivered from the foot-operated flow control valve will not need to be as great to allow the piston to deliver an impact against the anvil. This is because moving annular ring 91 (which is the central location of where piston 72 oscillates) to a closer distance to end face 84 of anvil 48 the inertia required for piston 72 to travel either side of annular ring 91 is less. With less inertia the impacts will be much lighter in force.

When the airflow is increased through the foot control (by depressing the foot control pedal) with the tool adjusted to either a short or long stroke setting the impact frequency as well as piston inertia will increase, thus delivering faster impact cycle times as well as an increase in impacting power within the range of the length of stroke setting. The foot control is used to control and meter air pressure/flow to the tool. This air pressure/flow will affect the piston oscillation within the scope of where the length of stroke adjustment is set. Adjusting the length of stroke setting to one location and fully depressing the foot control to a certain P.S.I. level will give a range of impacting speed and power. Adjusting the length of stroke setting to another location and fully depressing the foot control to the same P.S.I. level will give a different range of impacting speed and power. Physically moving the distance required for the piston to travel in order for it to collide with the anvil, increases the stroke length of the piston as well as the inertia of the piston because it has more time to gain a greater velocity before impact. Being able to adjust the annular ring 91 by simply turning length of stroke barrel 92 and thus altering the speed of impact and power ratio over all P.S.I levels provides a great benefit to the user. Jewelers and engravers can easily and quickly adjust this feature to their work requirements.

Figure 11:
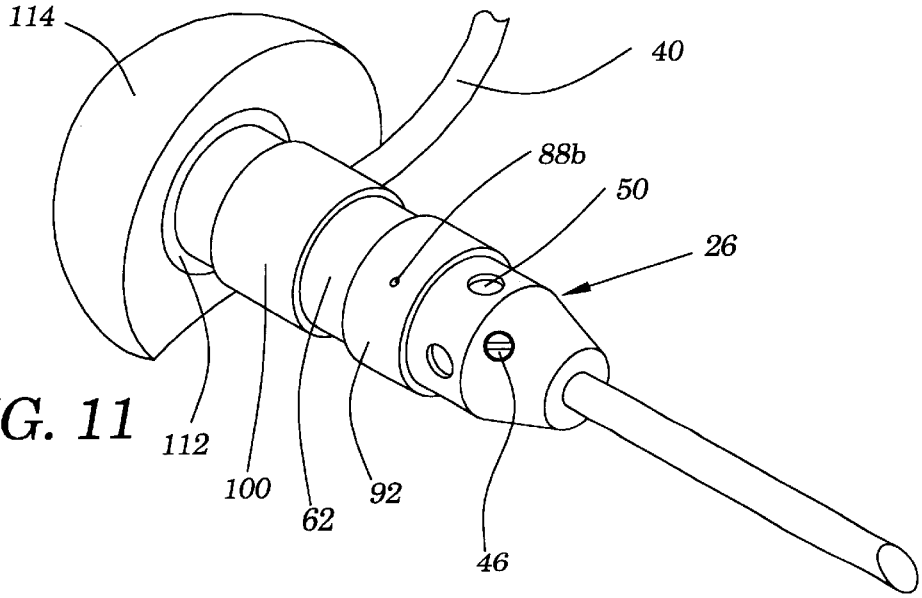
FIG. 11 is an elevated, isometric view of a handpiece of a hand hand-held impact power tool in accordance with the present invention.

Referring to FIG. 10 and FIG. 11, airline intake port 68 in attachment ring 100 is where reduced diameter delivery line 40 attaches. Attachment ring 100 may be rotated about and slid longitudinally along the axis of body shell 62 on an airtight seal of two o-rings 98 and 106, giving the user a great amount of adjustment possibilities for positioning the delivery line. In the isometric view in FIG. 11 the attachment ring 100 is depicted as rotated to one side.

Conclusion, Ramifications, and Scope

Accordingly, the reader will see that the hand-held pneumatic impact tool provides superb control and features for helping the jeweler or engraver carry out his work more easily and quickly. Furthermore, the invention has additional advantages in that:

- it provides an easily adjusted mechanism for users to adjust the length of piston stroke and impact speed of a hand-held impact power tool. The mechanism provides an annular band protruding around the outside diameter of the body of the power tool that may be turned for adjusting an annular ring in the bore of the power tool and thus altering the porting and the impacting characteristics of the impacting piston;
- it provides a feature for attaching air supply tubing to the power tool that may be moved around freely on the outside body of the power tool. The attachment feature provides an annular band around the outside diameter of the body of the power tool that attaches the air supply tubing. This annular band may be rotated or slid along the axis of the body to a position favored by the user;
- it provides a handle that may be manually pushed on and turned to lock. The feature provides more than one pin fixed into the female receptacle handle. These pins are radial aligned and protruding a short distance into the inside diameter of the female receptacle. Provided on the outside diameter of the body of the power tool are slots or grooves that permit the pins and handle to slide on and turn and thus tightening against an O-ring between the handle and body, thus sealing and holding the handle onto the body; and
- it provides a method that permits quick interchangeability of tool tips. The method provides a resilient o-ring material located inside of the tool holding recess for a friction fit to tool tips. The method also includes a setscrew that is perpendicular to the axis of the tool holding hole and is used to index square shank tool tips that are commonly used in the jewelry and engraving fields. The screw is left slightly loosened from the shanks of the tool tips so that tool tips may be removed and replaced quickly. This setscrew may also be used to tighten it on the shank permitting a more secure attachment.

Although the invention has been described with reference to the illustrated preferred embodiment, it is noted that equivalents may be employed and substitutions made herein without departing from the scope of the invention as recited in the claims. For example:

- One or more body shell intake ports 70, bore intake ports 60, piston ports 96, pins 55*a*, slots 56, exhaust ports 50, setscrews 46, pins 74, or slots 73 may be substituted over the number of those illustrated in the preferred embodiment.
- An equivalent may be employed by eliminating the length of stroke barrel 92 and attaching in its place a slide that does not use threads but is used by pushing it longitudinally along the handpiece axis. This slide may be a band totally around the diameter of the body, partially around the body or just a protrusion in one place on the body;
- An equivalent made be used by eliminating length of stroke barrel 92 and in its place providing an element protruding from the body attached to annular ring 91 (similar to pin 55*a*). This protrusion would be used for adjusting the annular ring 91;
- The foot control valve in FIG. 1 is illustrated with a horizontal pivoting pedal. This foot control may be replaced with any type of foot operated flow control valve;
- The piston pneumatic oscillation principle in the present invention utilizes air pressure for biasing the piston in both the forward impact stroke toward the anvil and in the return stroke away from the anvil may be substituted with a pneumatic oscillation principle that utilizes air pressure for biasing the piston in one direction (either toward or away from the anvil) and a spring for biasing the piston in the opposite direction; and
- The length of stroke adjustment is achieved in the invention by moving the piston's oscillation central location a farther distance or a closer distance to the fixed anvil. An equivalent embodiment may be achieved by moving the anvil closer or farther from the piston's oscillation central location or by moving both simultaneously apart or together.

Accordingly, the scope of the invention should be determined not by the embodiments illustrated, but by the appended claims and their legal equivalents.

I claim:

1. A hand-held pneumatic impact power tool for use in hand working operations for use with a supply of pressurized air, comprising:

- a body presenting a bore, the bore having a central longitudinal axis;
- a piston received within said bore and being shiftable relative to said body along said central longitudinal axis;
- an oscillation means by which said piston will oscillate back and forth a distance along said central longitudinal axis under the action of said supply of pressurized air;
- an anvil received within said bore;
- an impacting location within said bore located at a position along said central longitudinal axis where said piston and said anvil will collide;
- a second location within said bore defined as a location point along said central longitudinal axis where said piston just begins to receive sufficient energy for shifting directions from the direction it is traveling during the oscillation cycle even though said piston will continue to travel in its original direction for a time from inertia;

an adjustable means for adjusting the distance between said second location and said impacting location; and a manual means located on a said impact power tool body for the user of the said hand-held pneumatic impact power tool to manually adjust said adjustable means.

2. A hand-held pneumatic impact power tool as recited in claim 1, wherein said adjustable means is not adjusted by impact collisions between said piston and said anvil.

3. A hand-held pneumatic impact power tool as recited in claim 1, wherein said adjustable means is not adjusted by metering the air pressure or air flow from said supply of pressurized air.

4. A hand-held pneumatic impact power tool as recited in claim 1, wherein said manual means is in the form of an annular ring around said body and having a central longitudinal axis extending in a parallel direction with the central longitudinal axis of said body, said adjustable means being rotatable around said body.

5. A hand-held pneumatic impact power tool as recited in claim 1, further comprising: a foot-operated flow control valve including an inlet port in communication with said supply of pressurized air and an outlet port, said foot-operated flow control valve is movable between an off position in which the air flow is zero and a number of on positions in which the air flow ranges from zero to the pressure of said supply of pressurized air.

6. A hand-held pneumatic impact power tool as recited in claim 5, further comprising: a second flow control valve in communication with said supply of pressurized air and said body.

7. A hand-held pneumatic impact power tool for use in hand working operations for use with a supply of pressurized air, comprising:

a body presenting a bore and having first and second ends, the bore having a central longitudinal axis;

a piston received within said bore and being shiftable relative to the body along said central longitudinal axis;

an oscillation means by which said piston will oscillate under the action of said supply of pressurized air;

a handle containing a receiving-recess extending in a direction parallel with the central longitudinal axis of said bore; and a handle-attachment means to permit manual removal and installing of said handle, said handle-attachment means includes more than one protruding member positioned a distance into said receiving-recess, said handle-attachment means includes more than one groove on the outside diameter of said second end and running from said second end for a distance and then changes direction and rotates around the central longitudinal axis of said body a distance.

8. A hand-held pneumatic impact power tool for use in hand working operations for use with a supply of pressurized air, comprising:

a body presenting a bore and having first and second ends, the bore having a central longitudinal axis;

a piston received within said bore and being shiftable relative to the body along said central longitudinal axis;

an oscillation means by which said piston will oscillate under the action of said supply of pressurized air;

a handle containing a receiving-recess extending in a direction parallel with the central longitudinal axis of said bore; and a handle-attachment means to permit manual removal and installing of said handle, said handle-attachment means includes more than one protruding member positioned on the outside diameter of said second end, said handle-attachment means includes more man one groove on the inside diameter of said receiving-recess and then changes direction and rotates around the central longitudinal axis a distance.

* * * * *

UNITED STATES PATENT AND TRADEMARK OFFICE

CERTIFICATE OF CORRECTION

PATENT NO. : 6,488,102 B2
DATED : December 3, 2002
INVENTOR(S) : Steven J. Lindsay It is certified that error appears in the above-identified patent and that said Letters Patent is hereby corrected as shown below:

Column 9,
Line 8, after "located on" delete the word "a".

Signed and Sealed this

Seventeenth Day of June, 2003

JAMES E. ROGAN
*Director of the United States Patent and Trademark Office*